United States Patent [19]

Budzich et al.

[11] 4,445,355

[45] May 1, 1984

[54] GUIDE TUBE

[75] Inventors: Mieczyslaw Budzich, Lexington; Forest G. Fitz, Jr., West Columbia, both of S.C.

[73] Assignee: Nassau Recycle Corporation, Staten Island, N.Y.

[21] Appl. No.: 406,666

[22] Filed: Aug. 9, 1982

[51] Int. Cl.[3] ..... B21B 39/14

[52] U.S. Cl. ..... 72/250; 72/428; 226/196; 242/157 R

[58] Field of Search ..... 72/250, 428; 242/157 R; 226/196, 198; 254/389, 411, 134.3 FT; 164/417; 266/102, 104

[56] References Cited

U.S. PATENT DOCUMENTS

| | | | |
|---|---|---|---|
| 462,676 | 11/1891 | Allis | 72/428 |
| 650,887 | 6/1900 | Wilkerson | 242/157 R |
| 2,911,030 | 11/1959 | Kocks . | |
| 3,293,897 | 12/1966 | Holter . | |

*Primary Examiner*—Francis S. Husar
*Assistant Examiner*—Steven B. Katz
*Attorney, Agent, or Firm*—David P. Kelley

[57] ABSTRACT

A rod mill guide tube has a channel member of U-shaped cross-sectional configuration to which a cover member of T-shaped cross-sectional configuration is fastened whereby no seam edge is presented which a rod passing therethrough may contact.

4 Claims, 6 Drawing Figures

GUIDE TUBE

TECHNICAL FIELD

This invention relates to guide tubes used in guiding hot metallic rods or wires being advanced between process stations of a rod mill.

BACKGROUND OF THE INVENTION

Rod mills, such as those in which copper rod is formed from molten copper, typically have several manufacturing operations at different stations through which the copper rod is passed for processing. Some mills are designed in a manner requiring the rod be moved along a nonlinear path between stations in order to avoid an obstruction or to change direction or elevation. In such cases it is a common practice to provide a guide tube through which the rod is passed that effects a change in its direction of movement as by being routed over a roller mounted within the tube. Since the rod is moving at a rapid rate of speed, such as in excess of 200 kilometers per hour, it sometimes occurs that a "cobble" or entanglement of the rod is formed adjacent the entry end of the guide tube. These cobbles are most frequently created during start-up when a rough edge of the rod strikes a part of the rod processing equipment causing its movement to be impeded. If a cobble is formed adjacent the entry end of the guide tube it will rapidly back up and become entangled with the rod forming rolls or other processing apparatus located immediately upstream from the tube. To prevent this from happening the guide tubes have been designed to dissasemble whenever a cobble is formed about or within it. This feature has been provided by having the guide tube formed of two sections releasably fastened together so that when pressure exerted by the rod against the guide roller or the interior walls of the tube exceeds a certain amount one section is released from or "pops" off the other providing space above the tube to accommodate the cobble as it is formed before the line has been shut down.

More specifically, rod mill guide tubes have typically been in the shape of a hollow cylinder formed with a semi-cylindrical cover section fastened to a semi-cylindrical base section. The two sections have been fastened together by means of tie wires or spring clips secured to one section while overlaying the other. However, unless the two sections are and remain precisely aligned with one another the seam at their interfacing surfaces will present an edge to the tube interior. Furthermore, as a rod wobbles or whips about during its passage through the tube is applies varying degrees of pressure against the guide tube roller causing the two tube sections to move somewhat relative to each other and become misaligned. When this occurs any section edge or seam will become more exposed which can scratch or mar the rod. Accordingly, it is to the task of eliminating the just-described adverse characteristics of present day rod mill guide tubes that the invention is primarily directed.

SUMMARY OF THE INVENTION

In a preferred form of the invention a guide tube for guiding a hot metallic rod being advanced along a path of travel within a rod mill comprises a channel member of a substantially U-shaped cross-sectional configuration, an elongated cover member mounted to the channel member and having an elongated tongue slidably received within the channel member, and fastening means releasably holding the cover member to the channel member. So constructed, a hot metallic rod being advanced through the guide tube may create limited relative movement between the channel and cover members without the members becoming misaligned or an interior edge of the guide tube becoming exposed that could scratch or mar the rod.

DETAILED DESCRIPTION

Figure 2A:
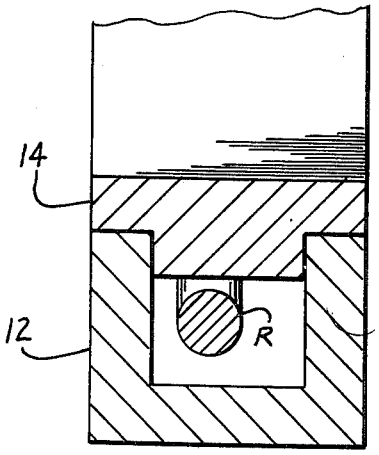
FIGS. 2A and 2B are cross-sectional views of a guide tube embodying principles of the present invention with the tube having two sections held snuggly together in FIG. 2A while held slightly apart in FIG. 2B.
Figure 2B:
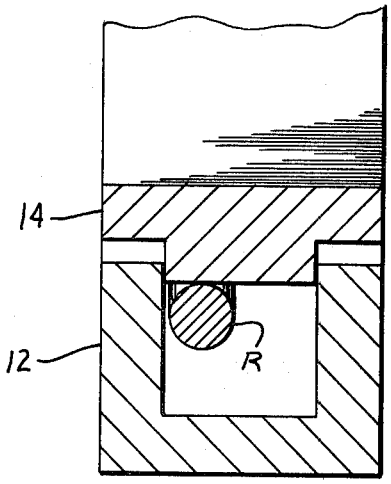
Figure 3:
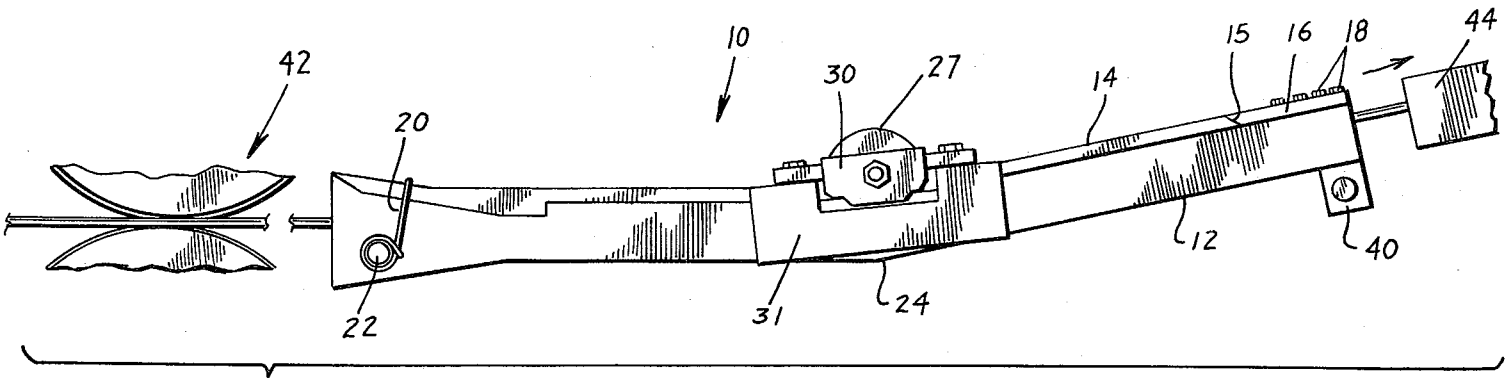
FIG. 3 is a side elevational view of a guide tube made in accordance with principles of the invention through which a rod is shown being advanced.
Figure 4:
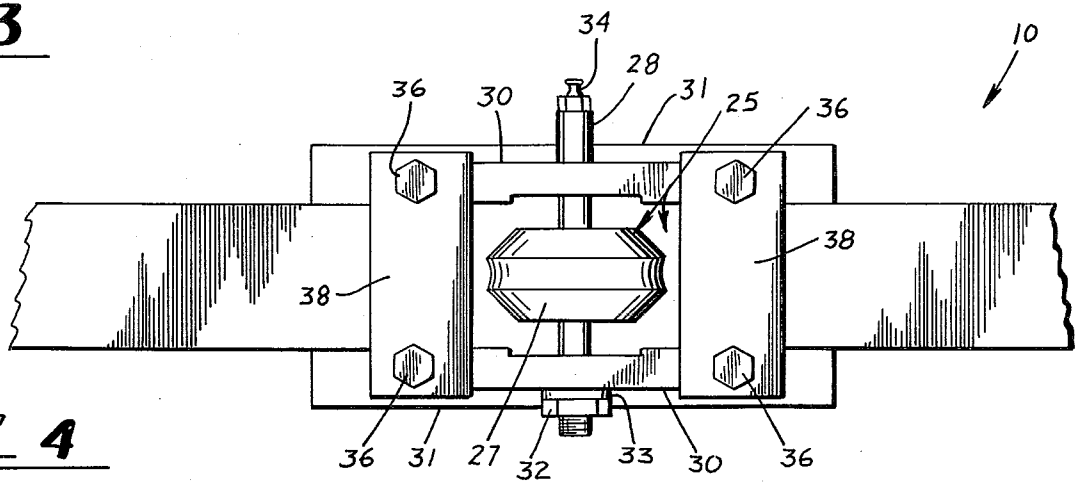
FIG. 4 is a plan view of a portion of the guide tube illustrated in FIG. 3.

With reference next to the drawings there is shown in FIGS. 2–4 a guide tube 10 having a channel 12 of a generally U-shaped cross-sectional configuration atop which a cover 14 is mounted that is of a generally T-shaped cross-sectional configuration. One end of the cover is beveled at 15 so as to be tucked under an end plate 16 which is permanently secured to the channel member by a set of bolts 18. The other end of the cover is releasably fastened to the channel member by a tie wire 20 or by a resilient spring clip that is looped over two coaxial support rods 22 that project laterally outwardly from the channel member.

The channel member 12 is seen to include two generally linearly extending portions that unitarily junction at juncture 24 to form a bend there in the order of some eleven degrees. Above this juncture the cover member is provided with an opening 25 in which a guide roller 27 is rotatably mounted by unshown ball bearings upon a shaft 28 to one end of which a grease fitting 34 is attached. In this position the roller extends downwardly within the interior of the U-shaped channel member. The shaft is mounted to the cover extending through two side plates 30 of a roller mounting bracket mounted atop two cover skirts 31. A pair of top plate members 38 of the roller mounting bracket is secured transversely atop the skirts 31 and the mounting bracket assembly fastened together and to the cover skirts by bolts 36. The guide tube as a whole is mounted with the aid of mounting brackets 40 in a position between a last set of rod finishing rolls 42 and a cooling tube 44.

Figure 1A:
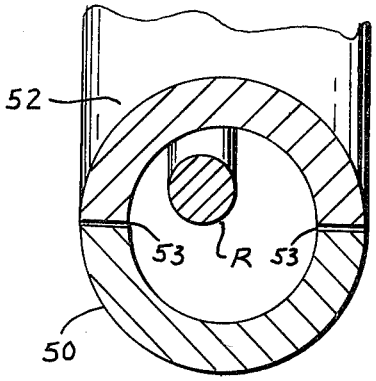
FIGS. 1A and 1B are cross-sectional views of a guide tube of the prior art with the tube shown with its sections in alignment in FIG. 1A and in misalignment in FIG. 1B.
Figure 1B:
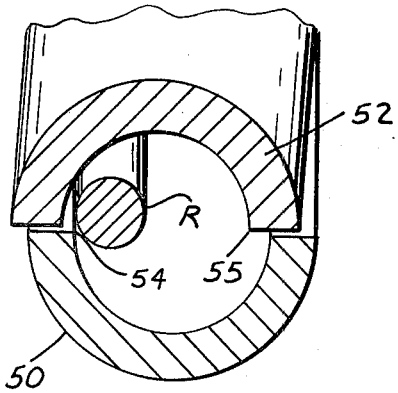
FIG. 1B PRIOR ART

With reference next to FIG. 1 a guide tube of the prior art is shown having a semi-cylindrical base 50 atop which a semi-cylindrical cover 52 is secured by unshown fastening means. In FIG. 1A it is seen that the two members are precisely aligned so as to be positioned about a common axis. Even here however it should be noted that a seam 53 is present which a rod R may contact. In FIG. 1B the cover has shifted slightly off of the base axis. In this position it is seen that as a rod R passes therethrough it may encounter an edge 54 of the base or an edge 55 of the cover. In FIG. 1B the rod R is in close proximity to the edge 54 of the base where it may easily become marred or scratched. However, with the guide tube of the present invention, as shown in FIG. 2, the just-described problem does not arise should the cover and channel components of the tube relocate with respect to each other. Indeed, the rod cannot contact the seam at any time. In FIG. 2A it is seen that the cover 54 is held snuggly atop the U-shaped channel member with no interior edge accessible for the rod to contact. In FIG. 2B though the cover has momentarily risen slightly off of the upper surface of the channel member. In doing this however the cover has stayed vertically aligned with the channel member and no sharp edge has become presented or accessible to the rod R since its radius of curvature is such that it cannot touch the interior corner where the two tube members meet. In this manner the previously described problem with the prior art guide tubes is solved.

It should be understood that the just-described embodiment merely illustrates principles of the invention in one preferred form. Though the tube member designated as the cover has been the one of T-shaped configuration and the tube member designated as the channel the one of U-shaped configuration, they could, of course, be interchanged so that the channel member was mounted atop the cover and/or had the opening that accommodated the roller. Many other modifications, additions and deletions may also be made without departure from the spirit and scope of the invention as set forth in the following claims.

What is claimed is:

1. A guide tube for guiding a hot metallic rod being advanced along a path of travel within a rod mill and with the guide tube comprising a channel member of substantially U-shaped cross-sectional configuration, an elongated cover member mounted to said channel member and having an elongated tongue slidably received within said channel member, and fastening means releasably holding said cover member to said channel member, whereby a hot metallic rod being advanced through the guide tube may create limited relative movement between the channel and cover members without the members becoming misaligned or an interior edge of the guide tube becoming exposed that would scratch or mar the rod.

2. A guide tube in accordance with claim 1 wherein said cover member is of a substantially T-shaped cross-sectional configuration.

3. A guide tube in accordance with claim 1 wherein said channel member and said cover member each have two linearly extending sections joined angularly together at a junction.

4. A guide tube in accordance with claim 3 wherein said cover member is formed with an opening at said juncture and wherein said guide tube further comprises a guide roller mounted to said cover at said juncture so as to extend rotatably down through said cover opening and into said channel member.

* * * * *